US012274405B2

(12) United States Patent
Xiao et al.

(10) Patent No.: US 12,274,405 B2
(45) Date of Patent: Apr. 15, 2025

(54) CLEANING ROBOT AND CONTROL METHOD THEREFOR

(71) Applicant: BEIJING ROBOROCK INNOVATION TECHNOLOGY CO., LTD., Beijing (CN)

(72) Inventors: Fujian Xiao, Beijing (CN); Haojian Xie, Beijing (CN); Qi Wu, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 507 days.

(21) Appl. No.: 17/640,325

(22) PCT Filed: Aug. 28, 2020

(86) PCT No.: PCT/CN2020/112086
§ 371 (c)(1),
(2) Date: Mar. 3, 2022

(87) PCT Pub. No.: WO2021/043080
PCT Pub. Date: Mar. 11, 2021

(65) Prior Publication Data

US 2022/0338700 A1 Oct. 27, 2022

(30) Foreign Application Priority Data

Sep. 5, 2019 (CN) ..... 201910838307.1

(51) Int. Cl.
*A47L 11/40* (2006.01)
*A47L 11/24* (2006.01)

(52) U.S. Cl.
CPC ..... *A47L 11/4011* (2013.01); *A47L 11/24* (2013.01); *A47L 2201/022* (2013.01); *A47L 2201/06* (2013.01)

(58) Field of Classification Search
CPC ..... A47L 11/4011; A47L 11/24; A47L 2201/022; A47L 2201/06; A47L 9/2805; A47L 9/2852; A47L 9/2873
See application file for complete search history.

(56) References Cited

U.S. PATENT DOCUMENTS

2007/0016328 A1* 1/2007 Ziegler ..... B60R 19/483 318/609
2018/0084965 A1 3/2018 Huang
2021/0055736 A1* 2/2021 Han ..... G05D 1/0217

FOREIGN PATENT DOCUMENTS

CN 106235954 A 12/2016
CN 107703930 A 2/2018
(Continued)

OTHER PUBLICATIONS

CN109038627 A; Dec. 2018; Machine translation (Year: 2018).*
(Continued)

*Primary Examiner* — David Redding
(74) *Attorney, Agent, or Firm* — Calfee, Halter & Griswold LLP

(57) ABSTRACT

Embodiments of the present disclosure provide a cleaning robot and a control method thereof. The cleaning robot includes a chassis; a drive system; an energy storage unit, supported by the chassis and includes at least one charging contact sheet, wherein the charging contact sheet protrudes from a plane of the chassis slightly, and the energy storage unit is configured to be charged according to a predetermined amount in a case that the robot is located at a charging station; and a control system, disposed on a main circuit board inside the cleaning robot and including a non-transitory memory and a processor, wherein the control system is configured to control the energy storage unit to charge
(Continued)

according to the predetermined amount based on a to-be-cleaned area and a total power consumption factor.

18 Claims, 5 Drawing Sheets

(56) References Cited

FOREIGN PATENT DOCUMENTS

| | | | | | |
|---|---|---|---|---|---|
| CN | 109038627 | | * | 12/2018 | ..... A47L 9/2884 |
| CN | 109984687 | A | | 7/2019 | |
| CN | 110136704 | A | | 8/2019 | |
| CN | 110623606 | A | | 12/2019 | |
| CN | 210931183 | U | | 7/2020 | |
| EP | 3412193 | A1 | | 12/2018 | |
| JP | 3192941 | U | | 8/2014 | |
| JP | 6384950 | B2 | | 9/2018 | |
| TW | 201909826 | A | | 3/2019 | |
| WO | WO 2019/056973 | A | | 3/2019 | |
| WO | WO 2019/126332 | A | | 6/2019 | |

OTHER PUBLICATIONS

PCT, International Search Report for PCT/CN2020/112086, Dec. 15, 2020.
TW, Office Action for Taiwanese application No. 109130110, Jul. 23, 2021.
Office action from Chinese Application No. 201910838307.1 dated Apr. 21, 2023.

* cited by examiner

CLEANING ROBOT AND CONTROL METHOD THEREFOR

CROSS REFERENCE TO RELATED APPLICATIONS

This application is a U.S. national phase of a PCT application No. PCT/CN2020/112086 filed on Aug. 28, 2020, which claims priority to Chinese Patent Application No. 201910838307.1 filed on Sep. 5, 2019, which is incorporated herein by reference in its entirety.

TECHNICAL FIELD

The present disclosure relates to the technical field of control, and in particular, to a cleaning robot and a control method thereof.

BACKGROUND

An autonomous robotic device includes an on-board power supply unit (typically a battery) that is recharged at a charging station or a docking station. Types and methods of charging stations (for example, radio signals, dead reckoning, ultrasonic beams, infrared beams coupled with radio signals and the like) searched by or docked with robots are quite different in effects and applications. A random collision-type autonomous cleaning device determines an obstacle to be approached and avoids it through collision sensors, ultrasonic sensors, infrared sensors and the like. In a case of low power and being required to return to a charging station, the charging station emits an infrared signal and the autonomous cleaning device travels randomly until "seeing" the charging station, and is guided to be docked into the charging station through the infrared signal, for charging. Based on a plurality of radiation regions formed by the infrared signals emitted from the charging station, the autonomous cleaning device can determine position information thereof according to which radiation region infrared signals are received from for positioning, and determine a direction of travel based on the position information, so that the autonomous cleaning robot travels to and is docked into the charging station for charging.

Currently, household cleaning robots may autonomously travel to the charging station for charging in a case that power is reduced to a set value. Currently, a common power management strategy is as follows: if power of a cleaning robot decreases to a minimum threshold, such as 5%, the cleaning robot may return to a charging station to be slowly charged to a set threshold, such as 80%; and if there is still an uncleaned region in a room at this time, cleaning will be restarted only after the cleaning robot is charged to the threshold. This method is not intelligent enough, is not convenient and fast, and is relatively low in comprehensive cleaning efficiency.

SUMMARY

In view of this, embodiments of the present disclosure provide a cleaning robot and a method of controlling charging of a cleaning robot for enabling the robot to be charged through an intelligent charging method.

According to a first aspect of a specific implementation of the present disclosure, an embodiment of the present disclosure provides a cleaning robot, including:

a chassis;

a drive system, including an offset drop-type suspension system, wherein the offset drop-type suspension system is movably fastened to the chassis and receives a spring bias downward and away from the chassis, and the spring bias is configured to keep a drive wheel in contact with a ground with a grounding force;

an energy storage unit, supported by the chassis and includes at least one charging contact sheet, wherein the charging contact sheet protrudes from a plane of the chassis slightly, and the energy storage unit is configured to be charged according to a predetermined amount in a case that the robot is located at a charging station; and a control system, disposed on a main circuit board inside the cleaning robot and including a non-transitory memory and a processor, wherein the control system is configured to control the energy storage unit to be charged to the predetermined amount based on a to-be-cleaned area and a total power consumption factor.

In an embodiment of the present disclosure, the total power consumption factor is obtained by following:

determining a quotient of dividing total power consumption of cleaning a total area for latest N times by N as a total power consumption factor, wherein N is an integer greater than or equal to 1.

In an embodiment of the present disclosure, the cleaning robot further includes:

a navigation apparatus, configured to monitor a cleaned area in real time and report the cleaned area to the control system which obtains a to-be-cleaned area according to the cleaned area, and including:

an optical receiver, disposed on an outer side of a machine body and configured to receive an optical signal emitted by the charging station; and a laser distance sensor, disposed on a top surface of the machine body and configured to create a map and to avoid an obstacle.

In an embodiment of the present disclosure, the control system is configured to determine a difference between a total area and the cleaned area as the to-be-cleaned area, and the total area is obtained by one of followings:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

According to a second aspect of a specific implementation of the present disclosure, an embodiment of the present disclosure provides a method of controlling charging of a cleaning robot, including:

monitoring, by a navigation apparatus, a cleaned area in real time and reporting the cleaned area to a control system which obtains a to-be-cleaned area according to the cleaned area; and obtains, by the control system, a predetermined charging amount according to the to-be-cleaned area and a total power consumption factor and controlling an energy storage unit to be charged according to the predetermined charging amount.

In an embodiment of the present disclosure, the total power consumption factor is obtained by:

determining a quotient of dividing total power consumption of cleaning a total area in latest N times by N as a total power consumption factor, wherein N is an integer great than or equal to 1.

In an embodiment of the present disclosure, a difference between a total area and the cleaned area is determined as the to-be-cleaned area, and the total area is obtained by one of followings:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

In an embodiment of the present disclosure, obtaining, by the control system, the a predetermined charging amount according to the to-be-cleaned area and a total power consumption factor includes:

determining a product of the to-be-cleaned area, the total power consumption factor and M as the predetermined charging amount, wherein M indicates a buffering factor, ranging from 1 to 1.5.

In an embodiment of the present disclosure, the method further includes:

monitoring, by the control system, remaining power of the energy storage unit in real time; changing traveling characteristics of the robot to guide the robot to a charging station for charging in a case that the remaining power reaches a designated threshold.

In an embodiment of the present disclosure, the method further includes:

in a case that the obtained predetermined charging amount is greater than an upper limit value or smaller than a lower limit value, charging according to the upper limit value or the lower limit value.

In an embodiment of the present disclosure, the method further includes: determining the predetermined charging amount as 80% in a case that the total power consumption factor is unavailable.

In an embodiment of the present disclosure, the method further includes: determining the predetermined charging amount as 80% in a case that a quantity of times of charging is determined to be greater than a predetermined quantity of times.

BRIEF DESCRIPTION OF THE DRAWINGS

In order to explain the technical solutions according to the embodiments of the present disclosure clearer, the drawings used in the description of the embodiments will be briefly introduced below. Obviously, the drawings in the following description are some embodiments of the present disclosure. One of ordinary skill in the art further can obtain other drawings based on these drawings without creative effects.

DESCRIPTION OF EMBODIMENTS

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. Obviously, the described embodiments are merely some embodiments, other than all embodiments, of the present disclosure. All other embodiments derived based on the embodiments of the present disclosure by one of ordinary skill in the art without creative efforts shall fall within the protection scope of the present disclosure.

It should be understood that although the terms "first", "second", "third", and the like may be used to describe "XXX" in the embodiments of the present disclosure, the "XXX" are not limited to the terms. These terms are only used to distinguish "XXX" from each other. For example, without departing from the scope of the embodiments of the present disclosure, the "first XXX" may alternatively be referred to as the "second XXX", and similarly, the "second XXX" may alternatively be referred to as the "first XXX".

Figure 1:
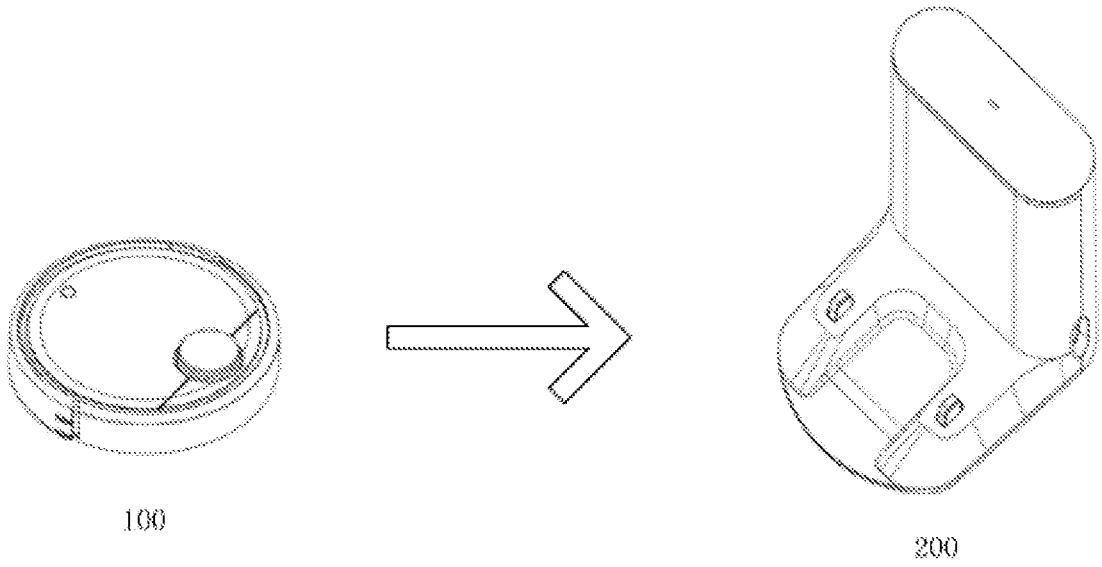
FIG. 1 illustrates a schematic view of an application scenario according to an embodiment of the present disclosure.

In order to describe the behaviors of the robot more clearly, the following direction definitions are provided:

In an application scenario diagram of the present disclosure, as illustrated in FIG. 1, an autonomous cleaning robot 100 performs cleaning operation in a designated region. In a case that the cleaning operation is completed or in a case that power is low, the autonomous cleaning robot 100 may automatically search for a position of a charging station 200. After the position of the charging station 200 is determined, the autonomous cleaning robot 100 automatically travels to the position of the charging station 200 for charging.

Figure 2:
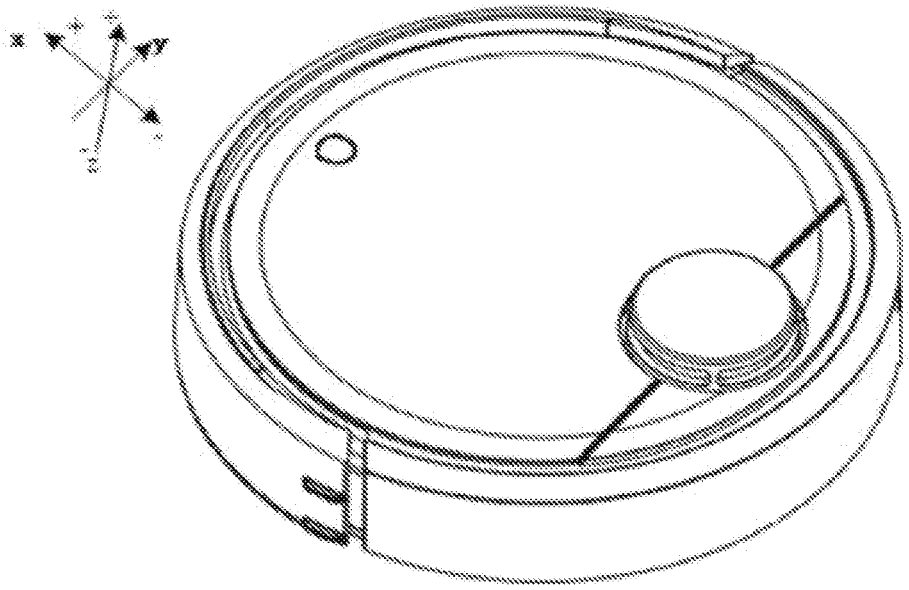
FIG. 2 illustrates a three-dimensional view of a structure of a robot according to an embodiment of the present disclosure.

As illustrated in FIG. 2, the autonomous cleaning robot 100 may travel on the floor through various combinations of movements with respect to the following three mutually perpendicular axes defined by a machine body 110: a front-rear axis X, a transverse axis Y, and a central vertical axis Z. A forward driving direction along the front-rear axis X is referred as "forward", and a backward driving direction along the front-rear axis X is referred as "backward". The direction of the transverse axis Y is a direction in which an axis defined by a center point of a drive wheel module 141 extends between a right wheel and a left wheel of the autonomous cleaning robot.

The autonomous cleaning robot 100 may rotate around the Y axis. "Upward" designates a case that a forward portion of the autonomous cleaning robot 100 is tilted upward, and a backward portion is tilted downward; and "downward" designates a case that the forward portion of the autonomous cleaning robot 100 is tilted downward, and the backward portion is tilted upward. In addition, the autonomous cleaning robot 100 may rotate around the Z axis. In a forward direction of the autonomous cleaning robot 100, "turn right" designates a case that the autonomous cleaning robot 100 is turned to a right side of the X axis; and "turn left": in a case that the autonomous cleaning device 100 is turned to a left side of the X axis.

Figure 3:
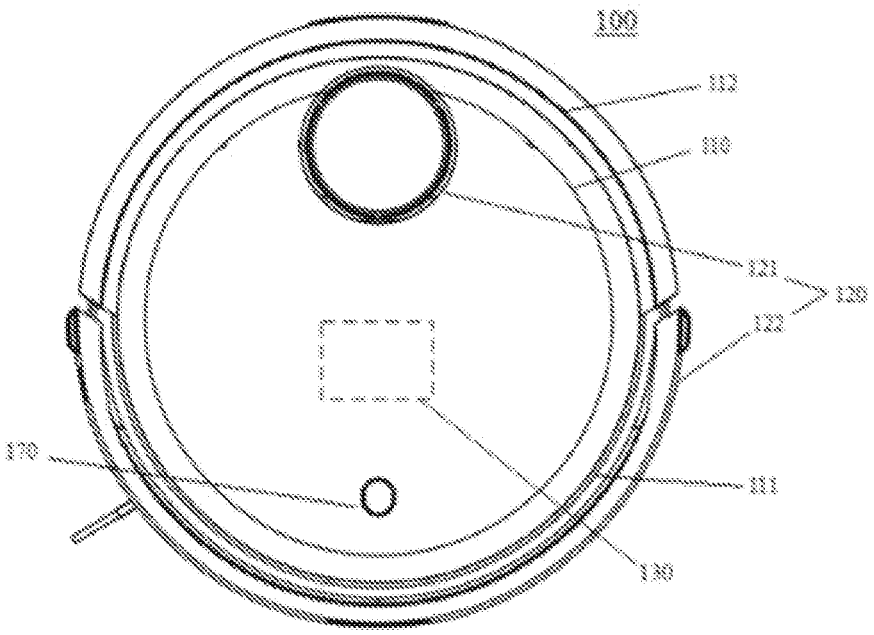
FIG. 3 illustrates a top view of a structure of a robot according to an embodiment of the present disclosure.

As illustrated in FIG. 3, the autonomous cleaning robot 100 includes a machine body 110, a sensing system 120, a control system 130, a drive system 140, a cleaning system 150, a power supply system 160, and a human-machine interaction system 170.

The machine body 110 includes a front portion 111, a rear portion 112, and a chassis portion 113. The machine body 110 has a substantially circular shape (both the front portion and the rear portion are circular), and may alternatively have other shapes, including, but not limited to, a substantially D shape in which the front portion is square and the rear portion is circular.

As illustrated in FIG. 3, the sensing system 120 includes a location determining apparatus 121 located above the machine body 110, a buffer 122 disposed at the front portion 111 of the machine body 110, and a sensing device such as a cliff sensor 123 and an ultrasonic sensor, an infrared sensor, a magnetometer, an accelerometer, a gyroscope, and an odometer, and provides various position information and movement state information of the autonomous cleaning robot to a control system 130. The location determining apparatus 121 includes, but is not limited to, a camera and a laser distance sensor (LDS). The following takes the laser distance sensor adopting a triangle ranging method as an example to explain how to determine the location. The basic principle of the triangle ranging method is based on an equivalence relationship between similar triangles, which is not described in detail herein.

The laser distance sensor includes a light emitting unit and a light receiving unit. The light emitting unit may include a light source that emits light, and the light source may include a light emitter, such as an infrared or visible light emitting diode (LED) that emits infrared light or visible light. Alternatively, the light source may be a light emitter that emits a laser beam. In this embodiment, the laser diode (LD) is used as a light source. In an embodiment of the present disclosure, due to the monochrome, directivity and collimating characteristics of a laser beam, adopting a light source of a laser beam may make a relatively accurate measurement with respect to other light. The laser diode (LD) may emit a spot laser to measure two-dimensional location information of an obstacle, or may emit a line laser to measure three-dimensional location information of an obstacle within a range.

A light receiving unit may include an image sensor on which a light spot reflected or scattered by an obstacle is formed. The image sensor may be an assembly of a plurality of unit pixels in a single row or a plurality of rows. These light receiving elements may convert optical signals into electric signals. The image sensor may be a complementary metal-oxide-semiconductor (CMOS) sensor or a charge-coupled device (CCD) sensor. In an embodiment of the present disclosure, the CMOS is adopted due to its advantages in cost. Moreover, the light receiving unit may include a light receiving lens assembly. Light reflected or scattered by an obstacle may pass through the light receiving lens assembly to form an image on the image sensor. The light receiving lens assembly may include a single lens or a plurality of lenses. A base may support the light emitting unit and the light receiving unit, which are arranged on the base and are spaced apart from each other by a distance. To range an obstacle around the autonomous cleaning robot, the base may be rotatably disposed on the machine body 110. Or, a rotating element may be provided to rotate the emitted light emitter and the received light, without rotating the base. A rotational angular velocity of the rotating element may be obtained by arranging a light coupling element and a code disc. The light coupling element senses a tooth notch in the code disc, and an instantaneous angular velocity may be obtained by dividing a circumferential length of the tooth notch by a notch passing time. The greater a density of tooth notches in the code disc is, the more accuracy the measurement is and the more precision the measurement is, while the more precision the structure is, and the greater the calculation complexity is. On the contrary, the less a density of tooth notches in the code disc is, the less accuracy the measurement is and the less precision the measurement is, while the less precision the structure is, and the less the calculation complexity is, thereby reducing cost.

A data processing device such as a DSP connected to the light receiving unit records distance values of obstacles at all angles relative to a 0-degree angle of the cleaning robot and transmits the distance values to a data processing unit of a control system 130, such as an application processor (AP) including a CPU, wherein the CPU obtains a current location of the robot though performing a particle filtering-based locating algorithm, so that the robot create a map for navigation based on the location. In an embodiment of the present disclosure, the locating algorithm adopts the simultaneous localization and mapping (SLAM).

The laser distance sensor based on the triangular ranging method may measure a distance value at an infinite distance beyond a distance in principle, but in fact, a long-distance measurement, for example, more than 6 meters, is very difficult to achieve mainly due to the restriction of a size of pixel units of the sensor of the light receiving unit and further influences of a photoelectric conversion speed of the sensor, a data transmission speed between the sensor and the connected DSP, and a calculation speed of the DSP. Change in a measured result due to effect on the laser distance sensor apparatus by a temperature may be intolerable for the system mainly due to the fact that thermal expansion and deformation of a structure between the light emitting unit and the light receiving unit causes angle changes between incident light and emergent light. A temperature drift may also occur to the light emitting unit and the light receiving unit. After the laser distance sensor is operated for a long time, deformation caused by accumulation of various factors such as temperature changes and vibration may further severely affect the measurement result. Accuracy of the measurement result directly determines accuracy of creating map, which is a basis for the cleaning robot to further perform a strategy.

As illustrated in FIG. 3, the front portion 111 of the machine body 110 may carry a buffer 122. In a case that the drive wheel module 141 propels the robot to travel on the floor in a cleaning process, the buffer 122 detects one or more events in a traveling path of the autonomous cleaning robot 100 through a sensor system, such as an infrared sensor. The autonomous cleaning robot 100 may control the drive wheel module 141 to respond to events, such as obstacles and walls, detected by the buffer 122, to for example stay away from the obstacles.

The control system 130 is mounted on a main circuit board of the machine body 110, including a computing processor, such as a central processing unit and an application processor, in communication with a non-transitory memory, such as a hard disk, a flash memory, and a random access memory, and based on obstacle information fed back by the laser distance sensor, the application processor create an instant map of the environment where the robot is located through a locating algorithm, such as the SLAM. In combination with distance information and speed information fed back by the sensing apparatus, such as the buffer 122, the cliff sensor 123 and the ultrasonic sensor, the infrared sensor, the magnetometer, the accelerometer, the gyroscope, and the odometer, the control system 130 comprehensively determines which operation state the autonomous cleaning robot is currently in, such as crossing a door threshold, climbing onto a carpet, being located at a cliff, being stuck at an upper position or at a lower position, a dust box being full, and being taken up, and may further provide a next specific action strategy for different situations, making operation of the autonomous cleaning robot meet requirements of a user well, and providing a good user experience. Further, the control system 130 may plan a cleaning routine and a cleaning manner, both of which are relatively efficient and reasonable, based on instant map information created through the SLAM, thereby improving the cleaning efficiency of the robot.

Figure 4:
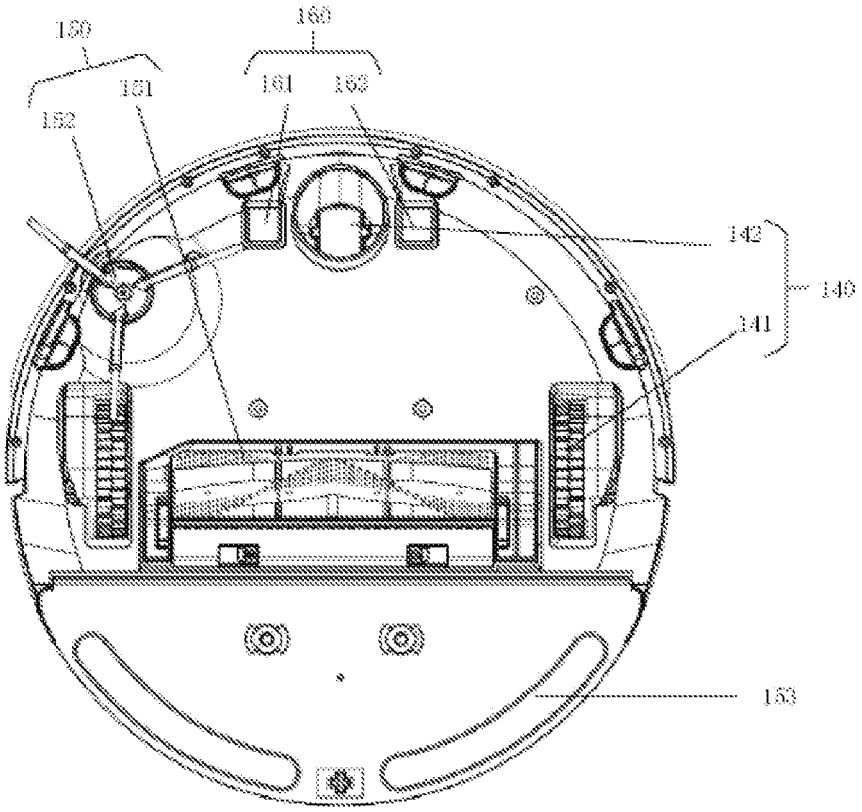
FIG. 4 illustrates a bottom view of a structure of a robot according to an embodiment of the present disclosure.

As illustrated in FIG. 4, the drive system 140 may drive the autonomous cleaning robot 100 to travel across the floor based on driving instructions having distance and angle information, such as x, y, and 0 components. The drive system 140 includes a drive wheel module 141 which may control left and right wheels at the same time. To control movement of the machine more accurately, the drive wheel module 141 includes a left drive wheel module and a right drive wheel module. The left and right drive wheel modules are disposed opposite to each other along the transverse axis defined by the machine body 110. To enable the autonomous cleaning robot to move more stably on the floor or have a stronger motion ability, the autonomous cleaning robot may include one or more driven wheel 142, which includes, but are not limited to, an universal wheel. The drive wheel module includes a traveling wheel, a drive motor, and a control circuit configured to control the drive motor. The drive wheel module may further be connected to both a circuit configured to measure a drive current and an odometer. The drive wheel module 141 may be detachably connected to the machine body 110 to facilitate disassembly and maintenance. The drive wheel may have an offset drop-type suspension system, which is fastened to the machine body 110 of the autonomous cleaning robot in a movable manner, for example, rotatably attached to the machine body 110 of the autonomous cleaning robot, and configured to receive a spring bias downward and biased away from the machine body 110 of the autonomous cleaning robot. The spring bias is configured to keep the drive wheel in contact and traction with the floor with a grounding force, and a cleaning element of the autonomous cleaning robot 100 further contact the floor 10 with a pressure.

The cleaning system may be a dry cleaning system 150 and/or a wet cleaning system 153. As a dry cleaning system, main cleaning functions of the system are provided by a cleaning system 151 consisting of a brushroll, a dust box, a fan, an air outlet, and connecting components between the four. The brushroll with a degree of interference with the floor sweeps garbage on the floor, takes it to a front of a dust suction opening between the brushroll and the dust box, and then suctions it into the dust box by a gas with a suction force which is generated by the fan and passes through the dust box. Dust removal capacity of the floor sweeper may be represented by cleaning efficiency of the garbage. The cleaning efficiency is affected by the structure and materials of the brushroll, and is also affected by a wind power utilization rate of an air duct formed by the dust suction opening, the dust box, the fan, the air outlet and the connecting components between the four, and by a type and power of the fan. Compared with ordinary plug-in vacuum cleaners, improvement in dust removal capacity is more significant for cleaning robots with limited energy. The improvement in the dust removal capacity directly reduces energy requirements, that is, the machine that may clean floor of 80 square meters with one charge originally can be improved to clean 100 square meters or more with one charge. In addition, a service life of a battery can be further prolonged greatly by reducing the number of charging times, so that a frequency of battery replacements by a user may further be decreased. The improvement in the dust removal capacity relates to the most apparent and important user experience, and the user may directly draw a conclusion whether sweeping/wiping is well done or not. The dry cleaning system may further include an edge brush 152 provided with a rotating shaft that is angled relative to the floor for bringing debris into a region of the brushroll of the cleaning system.

The wet cleaning system 153 mainly includes a detachable water tank (not shown) provided at a rear end of the chassis. The water tank is secured to a bottom end of the chassis by a snap structure or a plurality of securing screws. A bottom layer of the water tank includes a detachable mop (not shown), which is attached to a bottom layer of the water tank through pasting.

The power supply system 160 includes a rechargeable battery, such as a nickel-metal hydride battery and a lithium battery. The rechargeable battery may be connected to a charging control circuit, a battery pack charging temperature detecting circuit, and a battery under-voltage monitoring circuit, which are further connected to a single chip microcomputer control circuit. The autonomous cleaning robot is connected to the charging station through a charging electrode (which may be provided as a first charging contact sheet 161 and a second charging contact sheet 162) disposed on a side of the machine body or under the chassis for charging.

The human-machine interaction system 170 includes a button on a panel of the autonomous cleaning robot, the button configured for a user to select a function, further includes a display screen and/or an indicator lamp and/or a speaker, the display, the indicator lamp and the speaker presenting the user a current state of the autonomous cleaning robot or function options, and may further include a mobile phone client program. For a navigated autonomous cleaning robot, a mobile phone client may present a user a map of an environment in which the device is located and the location of the autonomous cleaning robot, and may provide the user with more enriched and more humanized function options.

Figure 5:
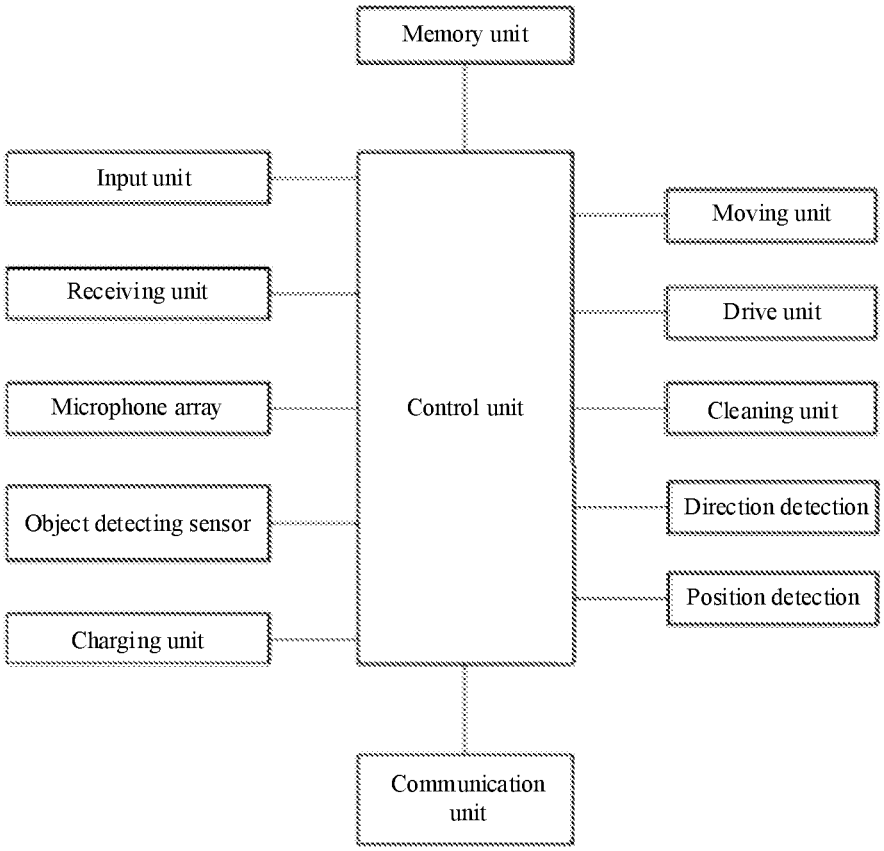
FIG. 5 illustrates a block diagram of a structure of a robot according to an embodiment of the present disclosure.

FIG. 5 illustrates a block diagram of electrical connection of an autonomous cleaning robot according to an embodiment of the present disclosure.

The autonomous cleaning robot according to the present embodiment may include a microphone array unit configured to recognize a voice of a user, a communication unit configured to communicate with a remote control device or another device, a moving unit configured to drive the machine body, a cleaning unit, and a memory unit configured to store information. An input unit (i.e., a button of a cleaning robot, or the like), an object detecting sensor, a charging unit, a microphone array unit, a direction detecting unit, a location detecting unit, a communication unit, a drive unit, and a memory unit may be connected to the control unit to transmit predetermined information to the control unit or receive predetermined information from the control unit.

The microphone array unit may compare voice input through the receiving unit with information stored in the memory unit to determine whether or not the input voice corresponds to an instruction. If it is determined that the input voice corresponds to an instruction, the corresponding instruction is transmitted to the control unit. If it is determined that the detected voice cannot match the information stored in the memory unit, the detected voice may be taken as noise and therefore is ignored.

For example, the detected voice corresponds to words "come, come here, get here, arrive here", and there is a text control instruction (come here) stored in the information of the memory unit corresponding to the words. In this case, the corresponding instruction may be transmitted to the control unit.

The direction detecting unit may detect a direction of the voice based a time difference or level of the voice input to the plurality of receiving units. The direction detecting unit transmits a detected direction of the voice to the control unit. The control unit may determine a moving path based on the detected direction of the voice by the direction detecting unit.

The location detecting unit may detect coordinates of the machine body in predetermined map information. In an embodiment, a current position of the machine body can be detected by comparing information detected by a camera and map information stored in the memory unit. In addition to the camera, the location detecting unit may further adopt a global positioning system (GPS).

In a broad sense, the location detecting unit may detect whether the machine body is located at a specific location or not. For example, the location detecting unit may include a unit configured to detect whether the machine body is located at the charging station or not.

For example, in a method of detecting whether the machine body is located at the charging station or not, whether or not the machine body is located at the charging station may be detected according to whether electric power is input into the charging unit or not. For another example, whether or not the machine body is located at the charging position may be detected by a charging position detecting unit disposed on the machine body or on the charging station.

The communication unit may transmit/receive predetermined information to/from the remote control device or another device. The communication unit may update map information of the autonomous cleaning robot.

The drive unit may operate the moving unit and the cleaning unit. The drive unit may move the moving unit along the moving path determined by the control unit.

The memory unit stores predetermined information correlated to operation of the cleaning robot. For example, map information of a region where the autonomous cleaning robot is located, control instruction information corresponding to a voice recognized by the microphone array unit, directional angle information detected by the direction detecting unit, location information detected by the location detecting unit, and obstacle information detected by the object detecting sensor may be stored in the memory unit.

The control unit may receive information detected by the receiving unit, the camera, and the object detecting sensor. The control unit may recognize the voice of the user, detect a direction in which the voice occurs, and detect a location of the autonomous cleaning robot based on the received information. In addition, the control unit can further operate the moving unit and the cleaning unit.

According to a first aspect of embodiments of the present disclosure, an embodiment of the present disclosure provides a cleaning robot, including:

a chassis, located at a bottom portion of the cleaning robot; a drive system, including an offset drop-type suspension system, wherein the offset drop-type suspension system is movably fastened to the chassis and receives a spring bias downward and away from the chassis, and the spring bias is configured to keep a drive wheel in contact with a ground with a grounding force; an energy storage unit, supported by the chassis and including at least one charging contact sheet, where the charging contact sheet protrudes from a plane of the chassis slightly, and the energy storage unit is configured to be charged according to a predetermined amount in a case that the robot is located at a charging station; and a control system, disposed on a main circuit board inside the cleaning robot and including a non-transitory memory and a processor, wherein the control system is configured to control the energy storage unit to be charged according to the predetermined amount based on a to-be-cleaned area and a total power consumption factor.

In an embodiment of the present disclosure, the total power consumption factor is obtained by:

determining a quotient of dividing total power consumption of cleaning a total area for latest N times by N as a total power consumption factor, wherein N is an integer greater than or equal to 1, for example, N=5.

In an embodiment of the present disclosure, the cleaning robot further includes: a navigation apparatus, configured to monitor a cleaned area in real time and report the cleaned area to the control system which obtains a to-be-cleaned area according to the cleaned area, where the navigation apparatus includes: an optical receiver, disposed on an outer side of a machine body and configured to receive an optical signal emitted by the charging station; and a laser distance sensor, disposed on a top surface of the machine body and configured to create a map and to avoid an obstacle.

In an embodiment of the present disclosure, the control system is configured to determine a difference between a total area and the cleaned area as the to-be-cleaned area, and the total area is determined by one of the following:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

Figure 6:
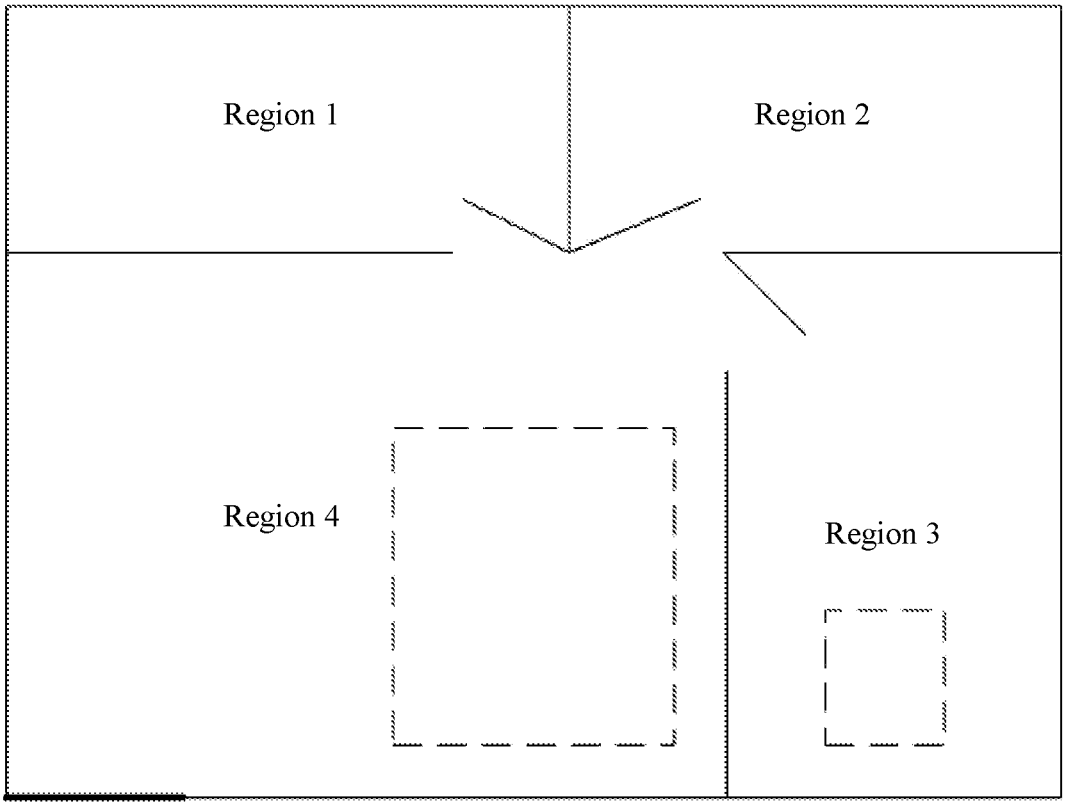
FIG. 6 illustrates a schematic structural view of a cleaning region of a robot according to an embodiment of the present disclosure.

A designated cleaning mode may be selected through a mobile phone APP or an autonomous cleaning robot configuration interface, and the cleaning mode includes a global cleaning mode, a region-selection cleaning mode, or a region-division cleaning mode. The global cleaning mode refers to cleaning an entire region in a map created by the navigation apparatus of the autonomous cleaning robot, for example, as illustrated in FIG. 6, the entire region of the created map with four sub regions, namely, a region 1 (bedroom 1), a region 2 (bedroom 2), a region 3 (kitchen), and a region 4 (living room). If the global cleaning mode is selected, the regions that the autonomous cleaning robot is required to clean include the four regions of the entire room, and the cleaning area is a sum of the areas of the four regions. The region-selection cleaning mode refers to a mode in which a user may select one or more regions among the region 1 (bedroom 1), region 2 (bedroom 2), region 3

(kitchen), and region 4 (living room) for cleaning. For example, if the region 1 is selected for cleaning, the autonomous cleaning robot performs cleaning within the region 1, and the cleaning area is the area of the region 1. The region-division cleaning mode refers to a mode in which a user may define a range for cleaning in any one or more of the region 1 (bedroom 1), region 2 (bedroom 2), region 3 (kitchen), and region 4 (living room) (for example, dotted regions in FIG. 6), the autonomous cleaning robot subsequently cleans only in a corresponding dotted regions, and the cleaning area is a sum of the areas of the two dotted regions in FIG. 6.

The objective of the present disclosure is to enable the cleaning robot, in a case of lower power of the cleaning robot, to be charged to a required amount according to the to-be-cleaned area at this time through obtaining the to-be-cleaned area based on a historical cleaning map record. After being charged to the required amount, the cleaning robot returns to a breakpoint for cleaning, which can greatly improve overall cleaning efficiency and improve user experience.

Figure 7:
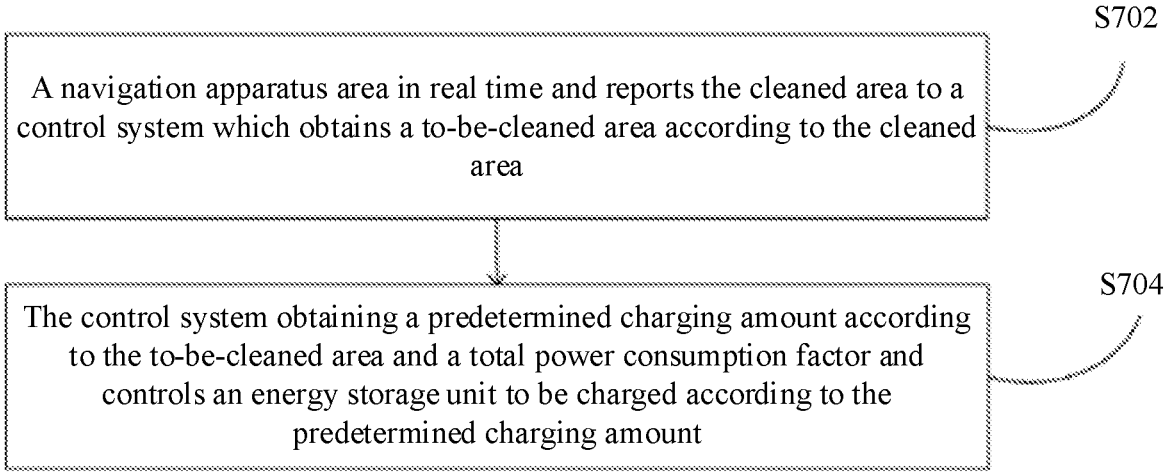
FIG. 7 illustrates a flowchart of a method of controlling a robot according to an embodiment of the present disclosure.

According to embodiments of the present disclosure, an embodiment of the present disclosure provides a method of controlling charging of a cleaning robot, as illustrated in FIG. 7, including:

S702: A navigation apparatus monitors a cleaned area in real time and reports the cleaned area to a control system which is configured to obtain a to-be-cleaned area according to the cleaned area.

In an embodiment of the present disclosure, the to-be-cleaned area is determined as a difference between a total area and the cleaned area, and the total area is obtained by one of following:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

The three modes are described above, and will not be repeatedly described herein.

Any total area may be determined as a sum of areas all cleaned regions through scanning, by the navigation apparatus, all the cleaned regions in multiple cleanings. The cleaned area or map is stored in a storage device of the cleaning robot, and may be displayed on a user APP in a terminal, so that the user can set the cleaning process on an interface of the APP.

S704: The control system determines a predetermined charging amount according to the to-be-cleaned area and a total power consumption factor and controls an energy storage unit to be charged according to the predetermined charging amount.

In an embodiment of the present disclosure, the total power consumption factor is obtained by:

determining a quotient of dividing total power consumption of cleaning a total area in latest N times by N as a total power consumption facto, wherein Nis an integer great than or equal to 1, for example, N=5.

In an embodiment of the present disclosure, the predetermined charging amount is obtained by: determining a product of the to-be-cleaned area, the total power consumption factor and M as the predetermined charging amount, wherein M indicates a buffering factor, ranging from 1 to 1.5. The introduction of M as the buffering factor is to take possible power consumption of the back and forth travel into account, to charge the cleaning robot to more than the required amount so as to ensure that the cleaning robot still has enough power in the end.

In an embodiment of the present disclosure, the method further includes: monitoring, by the control system, remaining power of the energy storage unit in real time, and in a case that the remaining power reaches a designated threshold, changing traveling characteristics of the robot to guide the robot to a charging station for charging in a case that the remaining power reaches a designated threshold.

In an embodiment of the present disclosure, the method further includes: in a case that the obtained predetermined charging amount is greater than an upper limit value or smaller than a lower limit value, charging according to the upper limit value or the lower limit value.

In an embodiment of the present disclosure, the method further includes: determining the predetermined charging amount as 80% in a case that the total power consumption factor is unavailable.

In an embodiment of the present disclosure, the method further includes: determining the predetermined charging amount as 80% in a case that a quantity of times of charging is determined to be greater than a predetermined quantity of times.

For example, if the remaining power is less than 20%, forced recharging is required and power required for cleaning the remaining area is determined. If the total power consumption factor is unavailable (the total power consumption factor cannot be calculated since it is the first cleaning), the cleaning is continued when the cleaning robot is charged to 80% of the power by default. If required power is determined to be greater than 95%, the cleaning is continued when the cleaning robot is charged to 95% of the power. If required power is calculated to be less than 30%, the cleaning is continued when the cleaning robot is charged to 30% of the power. The continuous cleaning can be supported up to 2 or 3 times at most, that is, there is a maximum of two breakpoints in one cleaning process. Otherwise, the cleaning efficiency is affected.

An embodiment may be described as: in a case that cleaning of the to-be-cleaned area is completed, the control system obtains a remaining power of the energy storage unit, and in a case that the remaining power is within a chargeable range (for example, 15%-25%), the control system controls the drive system of the cleaning device to search for a position of the charging station; and in a case that the position of the charging station is obtained, the cleaning device travels to a charging interface of the charging station for automatic charging.

Another embodiment may be described as: in a case that cleaning of the to-be-cleaned area is almost completed (for example, more than 90% of the remaining area is cleaned), the control system obtains the remaining power of the energy storage unit, and in a case that the remaining power reaches a threshold indicative of a requirement for charging (for example, 25%), the control system controls the drive system of the cleaning device to search for the position of the charging station; and in a case that the position of the charging station is obtained, the cleaning device travels to the charging interface of the charging station for automatic charging. If the charging threshold is not reached, charging is performed after completing cleaning of the remaining to-be-cleaned area.

The objective of the present disclosure is to enable the cleaning robot, in a case of low power of the cleaning robot, to be charged to a required amount according to the to-be-cleaned area at this time through obtaining the to-be-cleaned area based on a historical cleaning map record in a case of low power of the cleaning robot. After being charged to the required amount, the cleaning robot returns to a breakpoint for cleaning, which can greatly improve overall cleaning efficiency and improve user experience.

An embodiment of the present disclosure provides a cleaning robot, including a processor and a memory. The memory stores computer program instructions that can be executed by the processor. The processor, during executing of the computer program instructions, is configured to implement the method steps of any of the foregoing embodiments.

Embodiments of the present disclosure provide a non-transitory computer-readable storage medium storing computer program instructions that, in a case of being called and executed by a processor, operations of the method as described in any of the embodiments.

Figure 8:
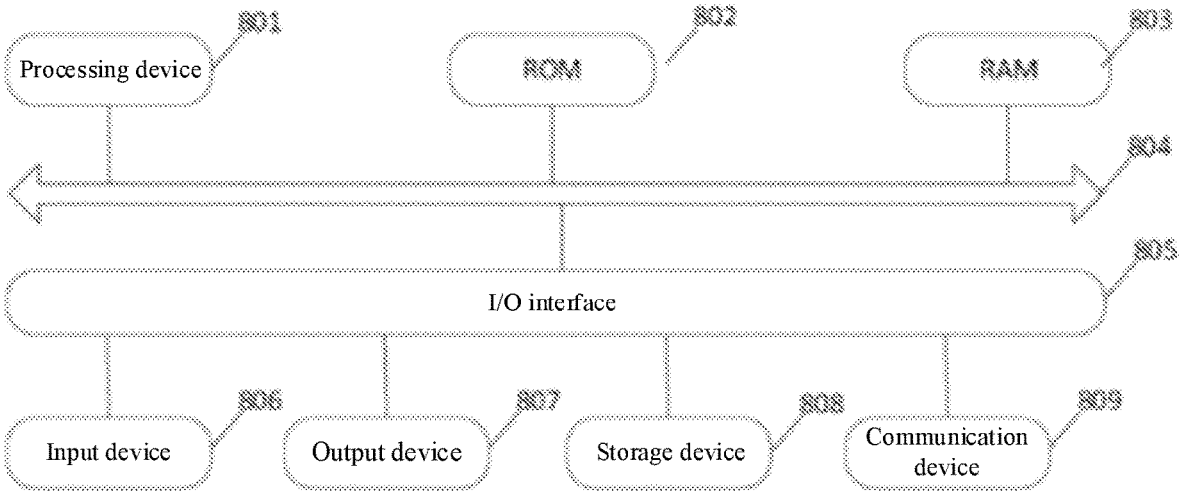
FIG. 8 illustrates a schematic view of an electronic structure of a robot according to an embodiment of the present disclosure.

As illustrated in FIG. 8, the autonomous cleaning robot may include a processing device (for example, a central processing unit, a graphics processor, or the like) 801, which may perform various appropriate actions and processes according to programs stored in a read-only memory (RAM) 802 or programs loaded into a random access memory (RAM) 803 from a storage device 808. The RAM 803 further stores various programs and data required for operation of the cleaning robot. The processing device 801, the ROM 802, and the RAM 803 are connected with each other through a bus 804. An input/output (I/O) interface 805 is further connected to the bus 804.

Typically, following devices may be connected to the I/O interface 805: an input device 806 including a touch screen, a touch panel, a keyboard, a mouse, a camera, a microphone, an accelerometer and a gyroscope or the like; an output device 807 including a liquid crystal display (LCD), a speaker, and a vibrator or the like; a storage device 808 including a magnetic tape and a hard disk or the like; and a communication device 809. The communication device 809 may allow the robot to communicate wirelessly or wiredly with another robot to exchange data. Although FIG. 8 illustrates the robot with various apparatuses, it should be understood that it is not required to implement or have all the apparatuses presented. More or fewer apparatuses may be implemented or provided instead.

In particular, according to an embodiment of the present disclosure, the process described above with reference to the flowchart may be implemented as a computer software program. For example, an embodiment of the present disclosure includes a computer program product including a computer program carried on a computer-readable medium, the computer program including program code for performing the method presented in the flowchart. In such an embodiment, the computer program may be downloaded and installed from a network through the communication device 809, or installed from the storage device 808, or installed from the ROM 802. In a case that the computer program is executed by the processing device 801, the above functions defined in the method according to the embodiment of the present disclosure are performed.

It should be noted that the computer-readable medium of the present disclosure may be a computer-readable signal medium or a computer-readable storage medium or any combination thereof. The computer-readable storage medium may be, for example, but not limited to, an electronic, magnetic, optical, electromagnetic, infrared, or semiconductor system, apparatus, or device, or any combination thereof. More specific examples of the computer-readable storage medium may include, but are not limited to: electrical connection with one or more wires, a portable computer disk, a hard disk, a random access memory (RAM), a read-only memory (ROM), an erasable programming read-only memory (EPROM or flash memory), an optical fiber, a portable compact disk read-only memory (CD-ROM), an optical storage apparatus, a magnetic storage apparatus, or any suitable combination thereof. In the present disclosure, the computer-readable storage medium may be any tangible medium that includes or stores a program that may be used by or used in combination by an instruction execution system, apparatus, or device. In the present disclosure, the computer-readable signal medium may include a data signal that is included in a baseband or propagated as part of a carrier wave, and carries computer-readable program code. Such a propagated data signal may use many forms, including but not limited to electromagnetic signals, optical signals, or any suitable combination thereof. The computer-readable signal medium may alternatively be any computer-readable medium other than a computer-readable storage medium, and the computer-readable signal medium may send, propagate, or transmit a program for use by or used in combination by an instruction execution system, apparatus, or device. Program code included in the computer-readable medium may be transmitted by using any appropriate medium, including but not limited to: wires, optical cables, radio frequency (RF), or the like, or any suitable combination thereof.

The computer-readable medium may be included in the foregoing robot, or may exist alone without being assembled to the robot.

Computer program code for performing the operations of the present disclosure may be written in one or more programming languages, or combinations thereof, which include object-oriented programming languages, such as Java, Smalltalk, C++, and further include procedural programming languages, such as "C" language or similar programming languages. The program code may be executed entirely on a user computer, partly on the user computer, as an independent software package, partly on the user computer, partly on a remote computer, or entirely on a remote computer or a server. In the case relating to the remote computer, the remote computer may be connected to the user computer through any network, including a local area network (LAN) or a wide area network (WAN), or connected to an external computer (such as Internet connection through an Internet service provider).

The flowchart and block diagrams in the accompanying drawings illustrate architectures, functions and operations that are possibly implemented by the systems, methods and computer program products according to various embodiments of the present disclosure. In this regard, each block in the flowchart or block diagram may represent a module, a program segment, or a part of code, which includes one or more executable instructions to implement a specified logical function. It should further be noted that in some alternative implementations, the functions marked in the blocks may alternatively occur in an order different from those marked in the accompanying drawings. For example, two blocks represented one after the other may actually be executed substantially in parallel, and may sometimes be executed in the reverse order, depending on the functions involved. It should further be noted that each block in the block diagrams and/or flowcharts, and combinations of blocks in the block diagrams and/or flowcharts, may be implemented by a dedicated hardware-based system that performs the specified function or operation, or may be implemented with a combination of dedicated hardware and computer instructions.

The units described in the embodiments of the present disclosure may be implemented by software or hardware. The name of the unit does not constitute a limitation on the unit itself in some cases.

The apparatus embodiments described above are only schematic, and the units described as separate parts may or may not be physically separated, and the parts displayed as units may or may not be physical units, that is, may be located at one place, or may be distributed across a plurality of network units. Some or all of the modules may be selected according to actual requirements to achieve the objective of the solution of this embodiment. One of ordinary skill in the art may understand and implement without creative effect.

Finally, it should be noted that the above embodiments are only used to illustrate the technical solution of the present disclosure, but not limited thereto. Although the present disclosure has been described in detail with reference to the foregoing embodiments, one of ordinary skill in the art should understand that modifications to the technical solutions described in the foregoing embodiments, or equivalent replacements of some of the technical features thereof may be made, so that the essence of the corresponding technical solution does not depart from the spirit and scope of the technical solution of various embodiments of the present disclosure.

What is claimed is:

1. A cleaning robot, comprising:

a chassis;

a drive system, comprising an offset drop-type suspension system, wherein the offset drop-type suspension system is movably fastened to the chassis and receives a spring bias downward and away from the chassis, and the spring bias is configured to keep a drive wheel in contact with a ground with a grounding force;

an energy storage unit, supported by the chassis and comprising at least one charging contact sheet, wherein the charging contact sheet protrudes from a plane of the chassis slightly, and the energy storage unit is configured to be charged according to a predetermined amount in a case that the robot is located at a charging station; and a control system, disposed on a main circuit board inside the cleaning robot and comprising a non-transitory memory and a processor, wherein the control system is configured to control the energy storage unit to be charged according to the predetermined amount based on a to-be-cleaned area and a total power consumption factor, wherein the cleaning robot further comprises:

a navigation apparatus, configured to monitor a cleaned area in real time and report the cleaned area to the control system which obtains a to-be-cleaned area according to the cleaned area.

2. The cleaning robot according to claim 1, wherein the total power consumption factor is obtained by:

determining a quotient of dividing total power consumption of cleaning a total area for latest N times by N as a total power consumption factor, wherein N is an integer great than or equal to 1.

3. The cleaning robot according to claim 1, wherein the navigation apparatus comprises:

an optical receiver, disposed on an outer side of a machine body and configured to receive an optical signal emitted by the charging station; and a laser distance sensor, disposed on a top surface of the machine body and configured to create a map and to avoid an obstacle.

4. The cleaning robot according to claim 3, wherein the control system is configured to determine a difference between a total area and the cleaned area as the to-be-cleaned area, and the total area is obtained by one of following:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

5. A method of controlling of charging of a cleaning robot, comprising:

monitoring, by a navigation apparatus, a cleaned area in real time and reporting the cleaned area to a control system which obtains a to-be-cleaned area according to the cleaned area; and obtaining, by the control system, a predetermined charging amount according to the to-be-cleaned area and a total power consumption factor and controlling an energy storage unit to be charged according to the predetermined charging amount.

6. The method according to claim 5, wherein obtaining the total power consumption factor by:

determining a quotient of dividing total power consumption of cleaning a total area in latest N times by N as a total power consumption factor, wherein N is an integer greater than or equal to 1.

7. The method according to claim 6, further comprising determining a difference between the total area and the cleaned area as the to-be-cleaned area, wherein the total area is obtained by one of following:

for a global cleaning mode, determining a maximum area in which autonomous cleaning is completed in a history of global cleaning as the total area;

for a region-selection cleaning mode, determining a sum of areas of all selected regions as the total area; and for a region-division cleaning mode, determining a sum of areas of all divided regions as the total area.

8. The method according to claim 7, wherein obtaining, by the control system, the predetermined charging amount according to the to-be-cleaned area and a total power consumption factor comprises:

determining a product of the to-be-cleaned area, the total power consumption factor and M as the predetermined charging amount, wherein M indicates a buffering factor, ranging from 1 to 1.5.

9. The method according to claim 8, further comprising:

monitoring, by the control system, remaining power of the energy storage unit in real time; and changing traveling characteristics of the robot to guide the robot to a charging station for charging in a case that the remaining power reaches a designated threshold.

10. The method according to claim 6, further comprising:

in a case that the obtained predetermined charging amount is greater than an upper limit value or less than a lower limit value, charging according to the upper limit value or the lower limit value.

11. The method according to claim 6, further comprising:

determining the predetermined charging amount as 80% in a case that the total power consumption factor is unavailable.

12. The method according to claim 10, wherein determining the predetermined charging amount as 80% in a case that a quantity of times of charging is determined to be greater than a predetermined quantity of times.

13. The method according to claim 7, further comprising:

in a case that the obtained predetermined charging amount is greater than an upper limit value or less than a lower limit value, charging according to the upper limit value or the lower limit value.

14. The method according to claim 8, further comprising:

in a case that the obtained predetermined charging amount is greater than an upper limit value or less than a lower limit value, charging according to the upper limit value or the lower limit value.

15. The method according to claim 9, further comprising:

in a case that the obtained predetermined charging amount is greater than an upper limit value or less than a lower limit value, charging according to the upper limit value or the lower limit value.

16. The method according to claim 13, wherein determining the predetermined charging amount as 80% in a case that a quantity of times of charging is determined to be greater than a predetermined quantity of times.

17. The method according to claim 14, wherein determining the predetermined charging amount as 80% in a case that a quantity of times of charging is determined to be greater than a predetermined quantity of times.

18. The method according to claim 15, wherein determining the predetermined charging amount at 80% in a case that a quantity of times of charging is determined to be greater than a predetermined quantity of times.

* * * * *